US008522566B2

(12) United States Patent
Leclear et al.

(10) Patent No.: US 8,522,566 B2
(45) Date of Patent: Sep. 3, 2013

(54) MEGA ICE BIN

(75) Inventors: Douglas D. Leclear, Benton Harbor, MI (US); Thomas L. Mueller, Saint Joseph, MI (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 857 days.

(21) Appl. No.: 12/637,113

(22) Filed: Dec. 14, 2009

(65) Prior Publication Data

US 2011/0138828 A1 Jun. 16, 2011

(51) Int. Cl.
*F25C 1/00* (2006.01)
*F25C 5/18* (2006.01)

(52) U.S. Cl.
USPC ..... 62/137; 62/344

(58) Field of Classification Search
USPC ..... 62/137, 182, 344, 449
See application file for complete search history.

(56) References Cited

U.S. PATENT DOCUMENTS

| | | | | |
|---|---|---|---|---|
| 2,826,899 | A * | 3/1958 | Muffly | 62/137 |
| 3,892,337 | A | 7/1975 | Neumann | |
| 5,240,150 | A | 8/1993 | Palmon | |
| D447,493 | S | 9/2001 | Shelley et al. | |
| 6,425,259 | B2 | 7/2002 | Nelson et al. | |
| 6,438,976 | B2 | 8/2002 | Shapiro et al. | |
| 6,442,954 | B1 | 9/2002 | Shapiro et al. | |
| D522,542 | S | 6/2006 | Czach et al. | |
| 7,185,507 | B2 | 3/2007 | Maglinger et al. | |
| 7,228,702 | B2 | 6/2007 | Maglinger et al. | |
| D568,345 | S | 5/2008 | Baacke et al. | |
| 2007/0113578 | A1 * | 5/2007 | Wu et al. | 62/344 |
| 2008/0272679 | A1 * | 11/2008 | Wuesthoff et al. | 312/404 |
| 2010/0037631 | A1 * | 2/2010 | Choi et al. | 62/66 |

* cited by examiner

*Primary Examiner* — Chen Wen Jiang
(74) *Attorney, Agent, or Firm* — Kirk W. Goodwin; Price Heneveld LLP

(57) ABSTRACT

An ice collection area is disposed inside the cabinet proximate an ice maker. An ice storage area is disposed inside the cabinet. A first relocatable ice bin is disposed inside the cabinet. The first relocatable ice bin is disposed in one of the ice collection area and the ice storage area. A second relocatable ice bin is disposed inside the cabinet. The second relocatable ice bin is disposed in the other of the ice collection area and the ice storage area.

11 Claims, 19 Drawing Sheets

MEGA ICE BIN

BACKGROUND OF THE PRESENT INVENTION

The present invention generally relates to an ice bin, and more specifically, to a large supplemental ice bin for use in appliances.

SUMMARY OF THE INVENTION

In one aspect of the present invention, an appliance includes a cabinet. An ice collection area is disposed inside the cabinet proximate an ice maker. An ice storage area is disposed inside the cabinet. A first relocatable ice bin is disposed inside the cabinet. The first relocatable ice bin is disposed in one of the ice collection area and the ice storage area. A second relocatable ice bin is disposed inside the cabinet. The second relocatable ice bin is disposed in the other of the ice collection area and the ice storage area.

In another aspect of the present invention, an appliance includes a cabinet. A first modular ice bin is disposed inside the cabinet. The first modular ice bin is locatable in a first position. The first modular ice bin receives ice and a second position. The first modular ice bin stores ice. A second modular ice bin is disposed inside the cabinet. The second modular ice bin is locatable in the first position. The second modular ice bin receives ice and the second position. The second modular ice bin stores ice.

In yet another aspect of the present invention, an appliance includes a cabinet. A first relocatable ice maker is disposed inside the cabinet and removably connected to the refrigerated cabinet proximate an ice dispensing area. A second relocatable ice maker is disposed inside the appliance proximate an ice storage area.

These and other features, advantages, and objects of the present invention will be further understood and appreciated by those skilled in the art upon studying the following specification, claims, and appended drawings.

DETAILED DESCRIPTION OF EMBODIMENTS

Figure 1:
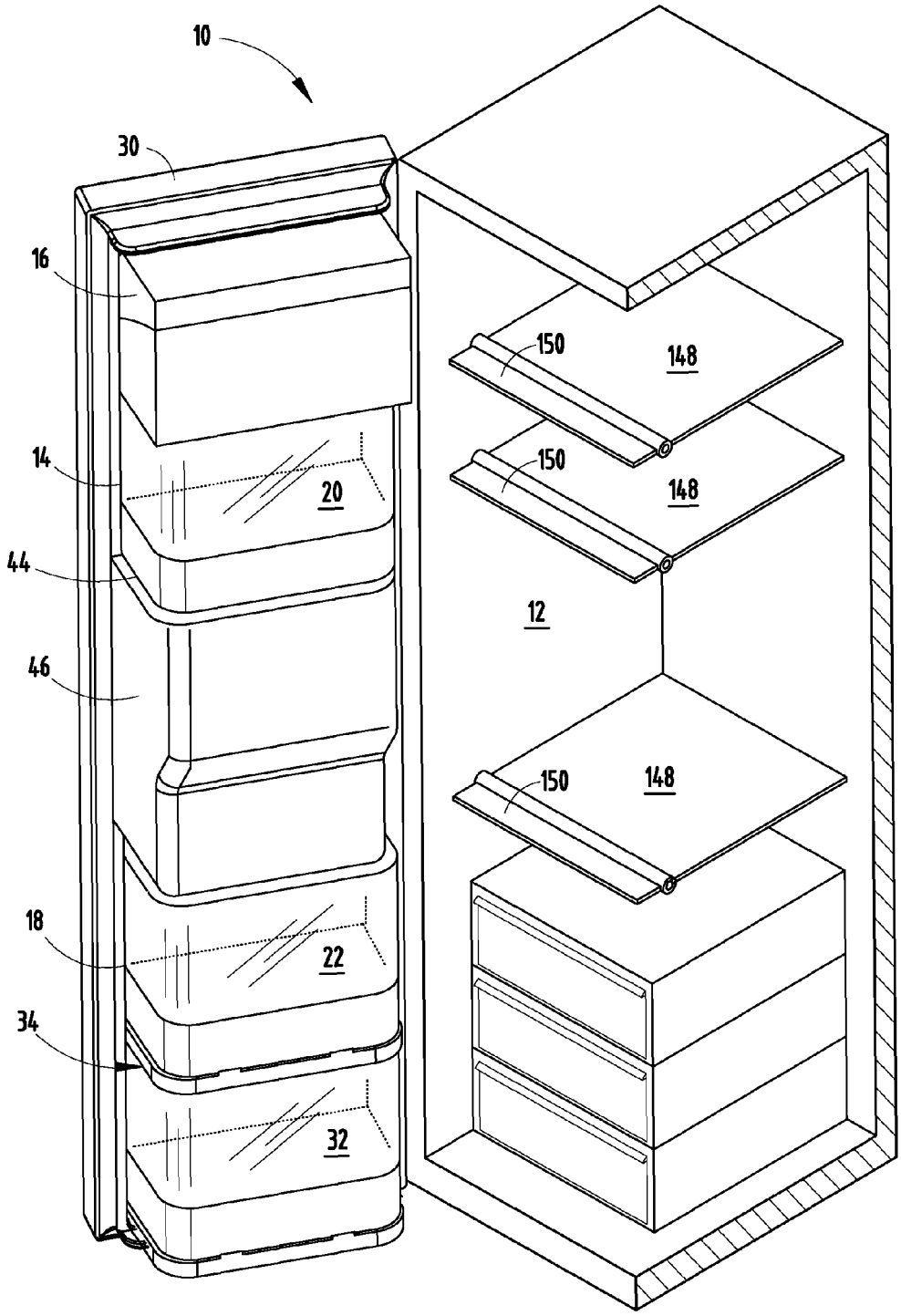
FIG. 1 is a top perspective view of a refrigerator incorporating one embodiment of an ice bin configuration of the present invention.
Figure 2:
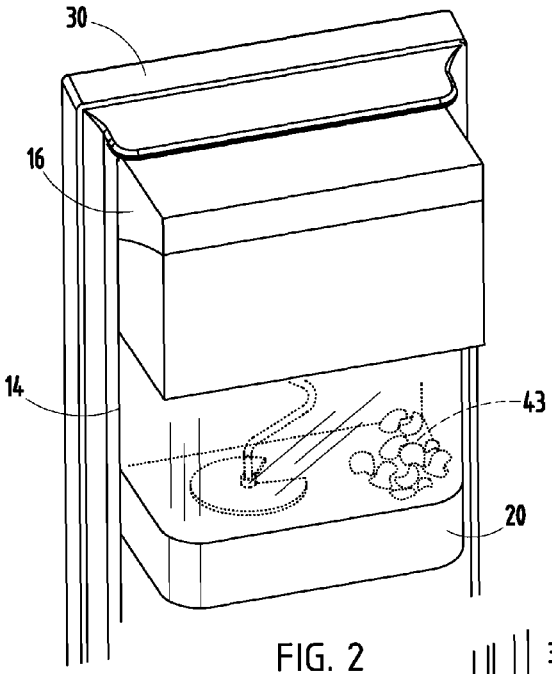
FIG. 2 is an enlarged view of one embodiment of an ice bin of the present invention.
Figure 3:
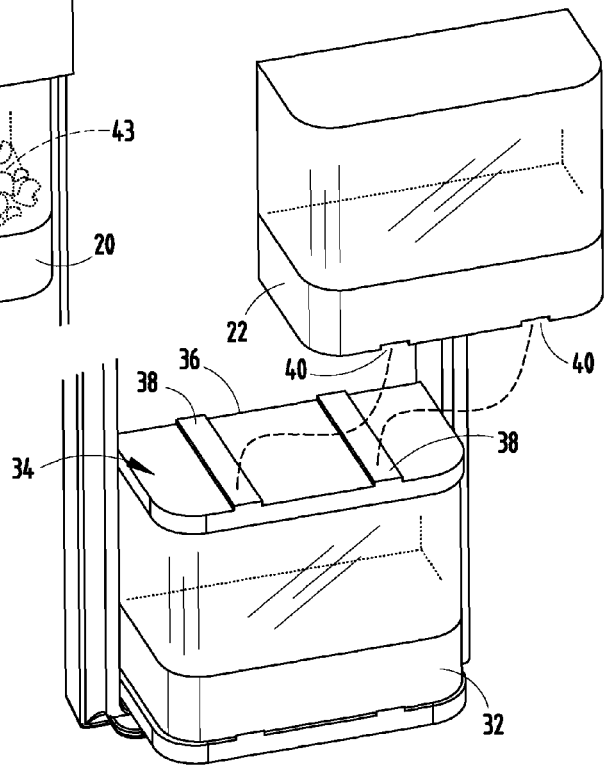
FIG. 3 is a top perspective view of a shelving system.
Figure 4:
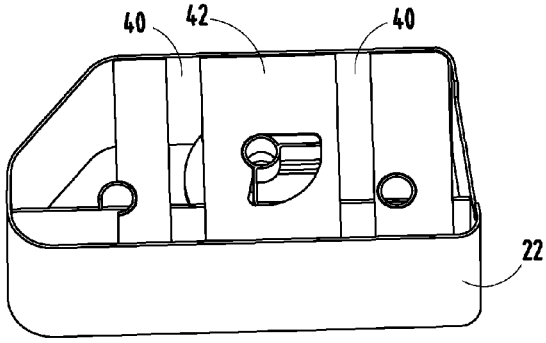
FIG. 4 is a bottom elevational view of one embodiment of an ice bin.

For purposes of description herein the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates an appliance including a cabinet 12. An ice collection area 14 is disposed inside the cabinet 12 proximate an ice maker 16. An ice storage area 18 is disposed inside the cabinet 12. In addition, a first relocatable ice bin 20 is disposed inside the cabinet 12 and is disposed in one of the ice collection area 14 and the ice storage area 18. A second relocatable ice bin 22 is also disposed inside the cabinet 12. The second relocatable ice bin 22 is disposed in the other of the ice collection area 14 and the ice storage area 18.

Referring again to the embodiment illustrated in FIGS. 1-4, the appliance, such as the refrigerator illustrated, includes at least one freezer door 30 rotatably connected therewith and which forms a sealed interior with the cabinet 12 when the door 30 is closed. The freezer side door 30 includes the first relocatable ice bin 20, the second relocatable ice bin 22, and a third relocatable ice bin 32. To support each of the ice bins 20, 22, 32, a door shelf rail system 34 is installed that secures each of the ice bins 20, 22, 32 in position in the door 30. The ice bins 20, 22, 32 are held in place vertically by the geometric constraints of the door 30 and horizontally by the door shelf rail system 34, which mates the bottom of each ice bin 20, 22, 32 to the top of a cantilevered shelf 36. Each shelf 36 in the door shelf rail system 34 includes two rails 38 that matably engage two receiving slots 40 on a bottom wall 42 of the first, second, and third relocatable ice bins 20, 22, 32. The door shelf rail system 34 allows dispensing of ice 43 through the bottom wall 42 and does not inhibit the ice bins 20, 22, 32 from interfacing correctly with an ice distribution top plate 44 when any one of the ice bins 20, 22, 32 are placed in ice collection area 14 above an external ice dispenser 46. A latch system (not shown) is used to lock the second and third relocatable ice bins 22, 32 into place in the ice storage area 18.

Referring again to the embodiment illustrated in FIGS. 1-4, the multi-bin system shown allows a consumer to store three times as much ice 43 in the freezer cabinet 12 as could typically be done with a single ice bin. When the first relocatable ice bin 20 disposed adjacent to the ice collection area 14 is full, a user may remove the first relocatable ice bin 20 and replace the first relocatable ice bin 20 with either the second relocatable ice bin 22 or the third relocatable ice bin 32 disposed in the ice storage area 18 in the door 30. The full first relocatable ice bin 20 may then be stored in the vacated position in the ice storage area 18. In the event that additional ice bins are not desired by the user, the user may remove one or both of the second and third relocatable ice bins 22, 32, as well as the door shelf rail system 34, and install a standard shelving system that is engageable with the door 30, as is typically known by a person of ordinary skill in the art.

Although the illustrations as shown incorporate multiple ice bins 20, 22, 32 disposed in the refrigerator door 30, it is also contemplated that the ice bins 20, 22, 32 may be stored in a portion of the cabinet 12 of the appliance 10. Additionally, although the ice bins 20, 22, 32 are shown vertically arranged in a linear fashion, it is also contemplated that the ice bins 20, 22, 32 could be arranged horizontally, for example, in a top portion of the cabinet 12.

Figure 5:
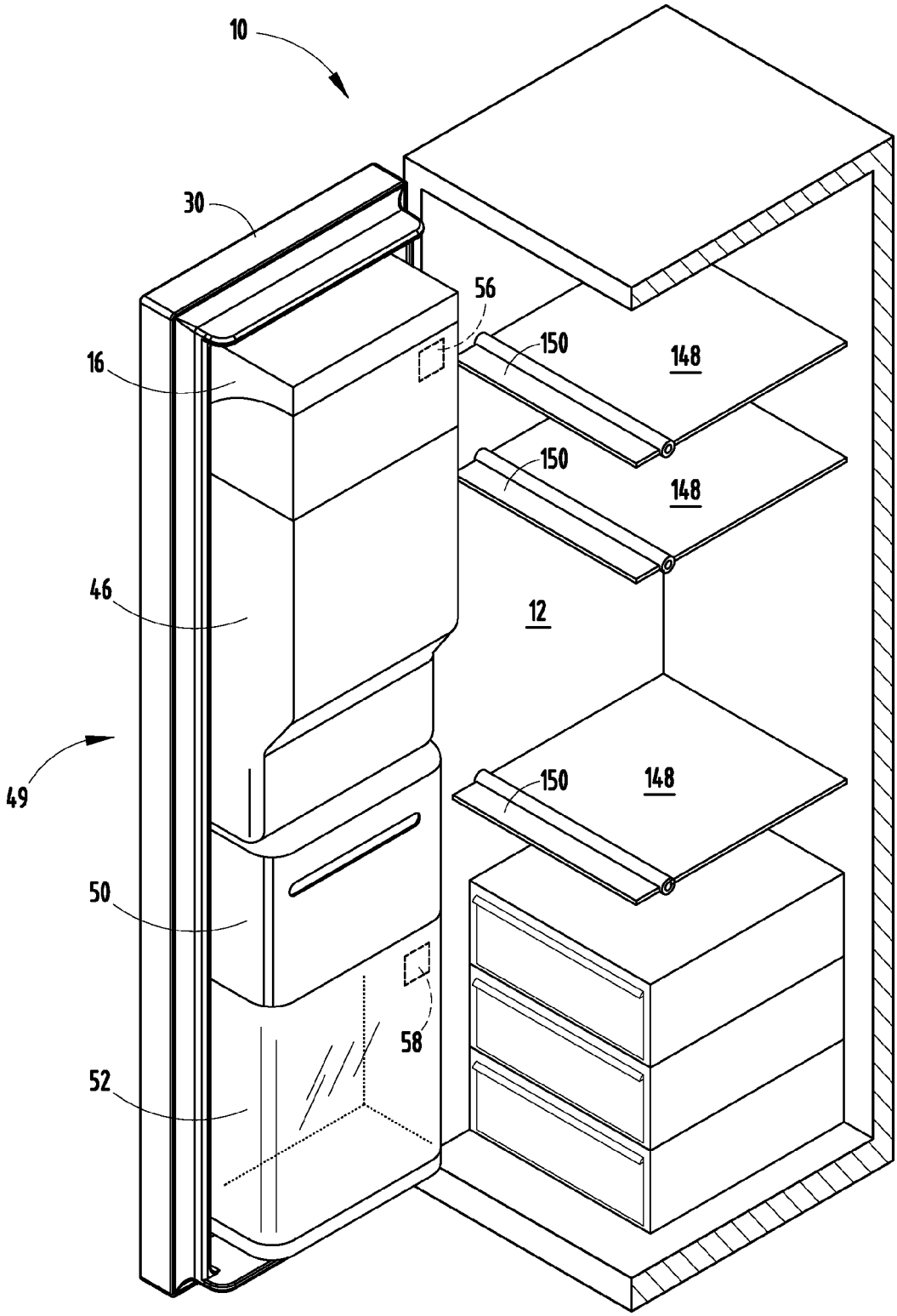
FIG. 5 is a top perspective view of a refrigerator incorporating one embodiment of a dual ice maker system.
Figure 6:
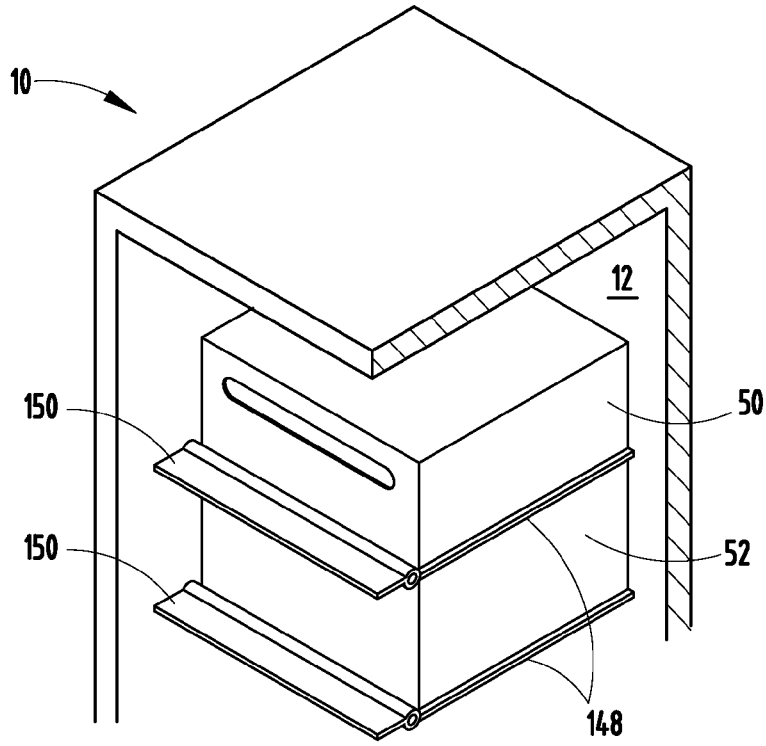
FIG. 6 is a top perspective view of an appliance incorporating one embodiment of a dual ice maker system with at least one of the ice makers disposed in the cabinet.

Referring now to the embodiment illustrated in FIGS. 5 and 6, a multiple ice maker system 49 includes a second ice maker 50 that may be installed into the appliance door 30 (FIG. 5) or into the appliance cabinet 12 (FIG. 6). The versatility of installation allows for ice 43 to be produced and stored in an alternate location relative to the first ice maker 16 and also increases the overall ice production rate of the appliance 10. Stated differently, ice 43 is produced and stored by the primary ice maker 16 and dispensed through the external ice dispenser 46 to the consumer for everyday use, while at the same time, ice 43 is produced separately by the second ice maker 50 that is disposed in the cabinet 12 (FIG. 6) or in the door 30 (FIG. 5). The ice 43 made by the second ice maker 50 is not operably connected to the external ice dispenser 46 for dispensing ice 43, but dispenses to a high volume ice bin 52 that has a high internal ice storage capacity. The ice 43 in the second ice maker 50 stays in the high volume ice bin 52 until manually removed. A sensor 56 is used to measure the level of the ice 43 in the first relocatable ice bin 20. A second sensor 58 may be disposed proximate the high volume ice bin 52 to monitor the volume of ice 43 collected in the high volume ice bin 52.

Figure 7B:
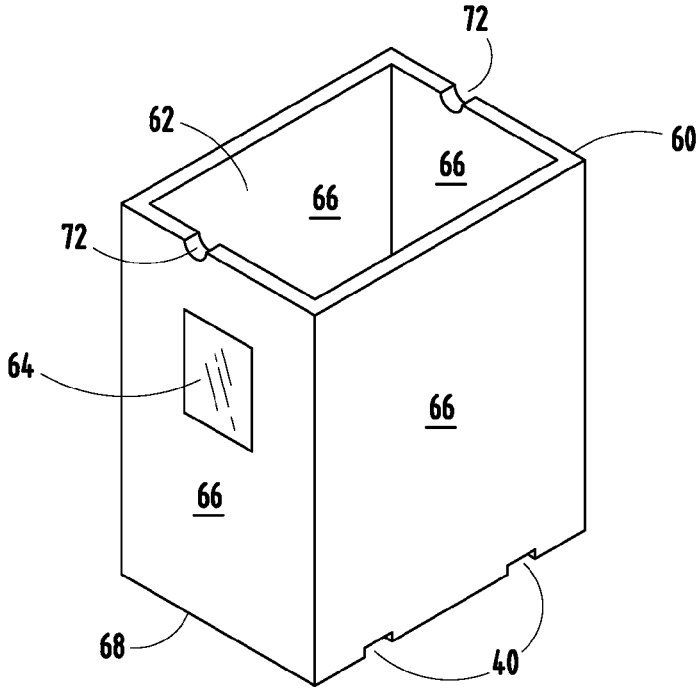
FIG. 7B is a top perspective view of one embodiment of an door ice bin.
Figure 7A:
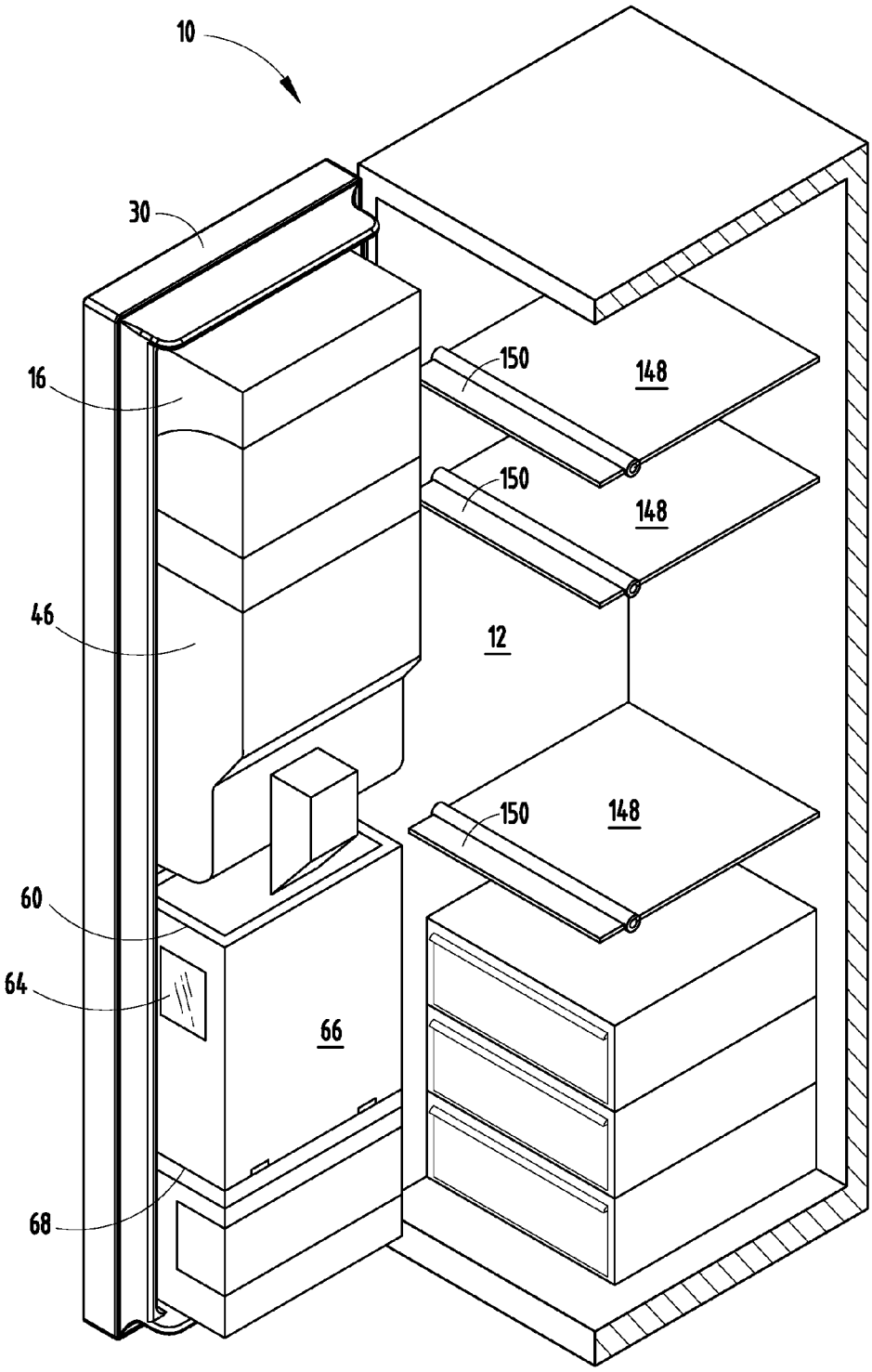
FIG. 7A is a top perspective view of one embodiment of an in-door storage system.

FIGS. 7A and 7B illustrate one embodiment of a door ice bin 60, which includes a substantially rectangular construction with an open top 62 and a viewing pane 64 disposed in one or more walls 66 of the door ice bin 60. A bottom portion 68 of the door ice bin 60 includes two rail receiving slots 40 designed to engage the rails 38 on the supporting shelf 36 connected with the door 30 of the appliance 10. A top portion of the door ice bin 60 may also include slots 72 designed to hold a hinged door (not shown) that is operable between open and closed positions.

Figure 7C:
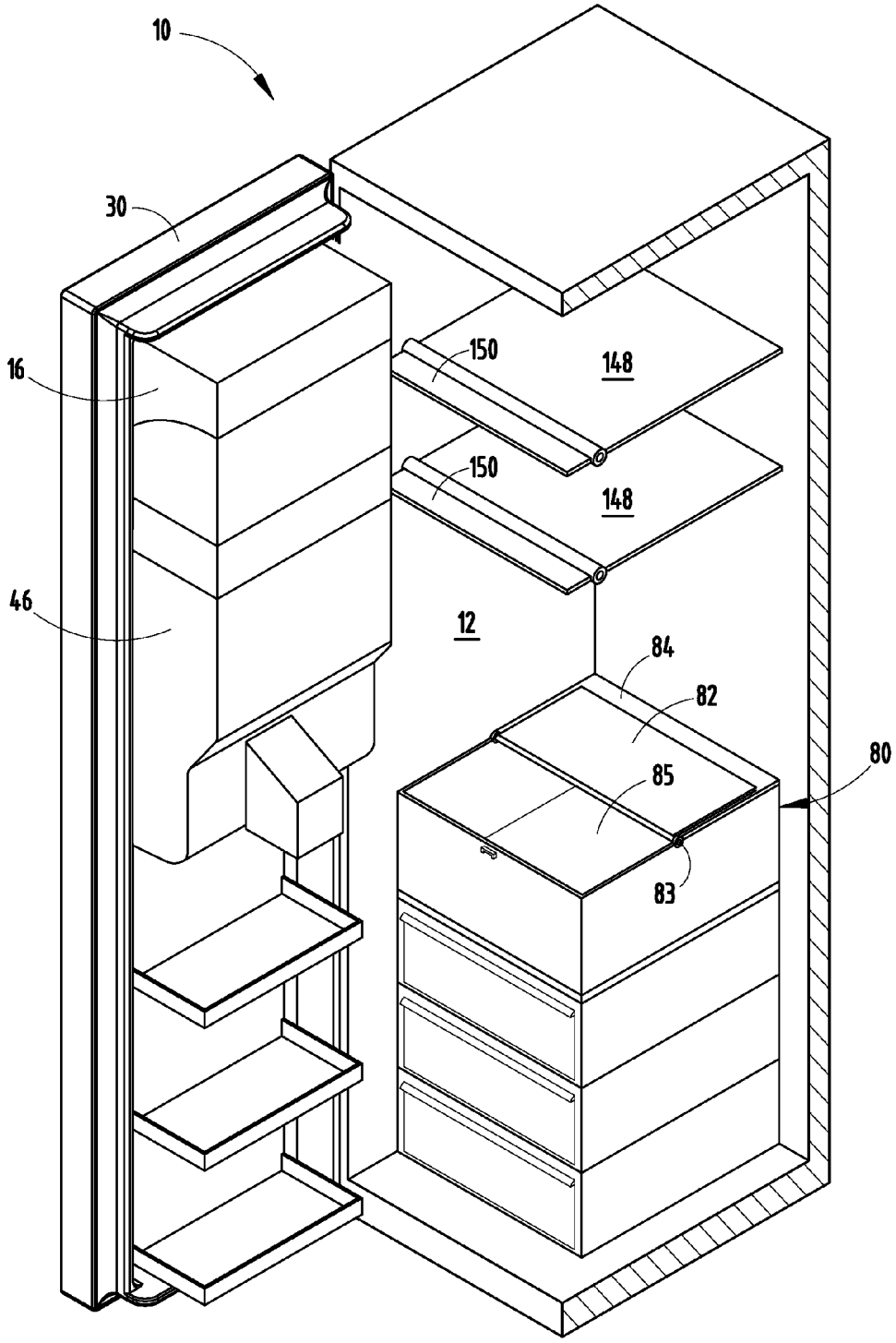
FIG. 7C is a top perspective view of one embodiment of an in-cabinet storage system.
Figure 9:
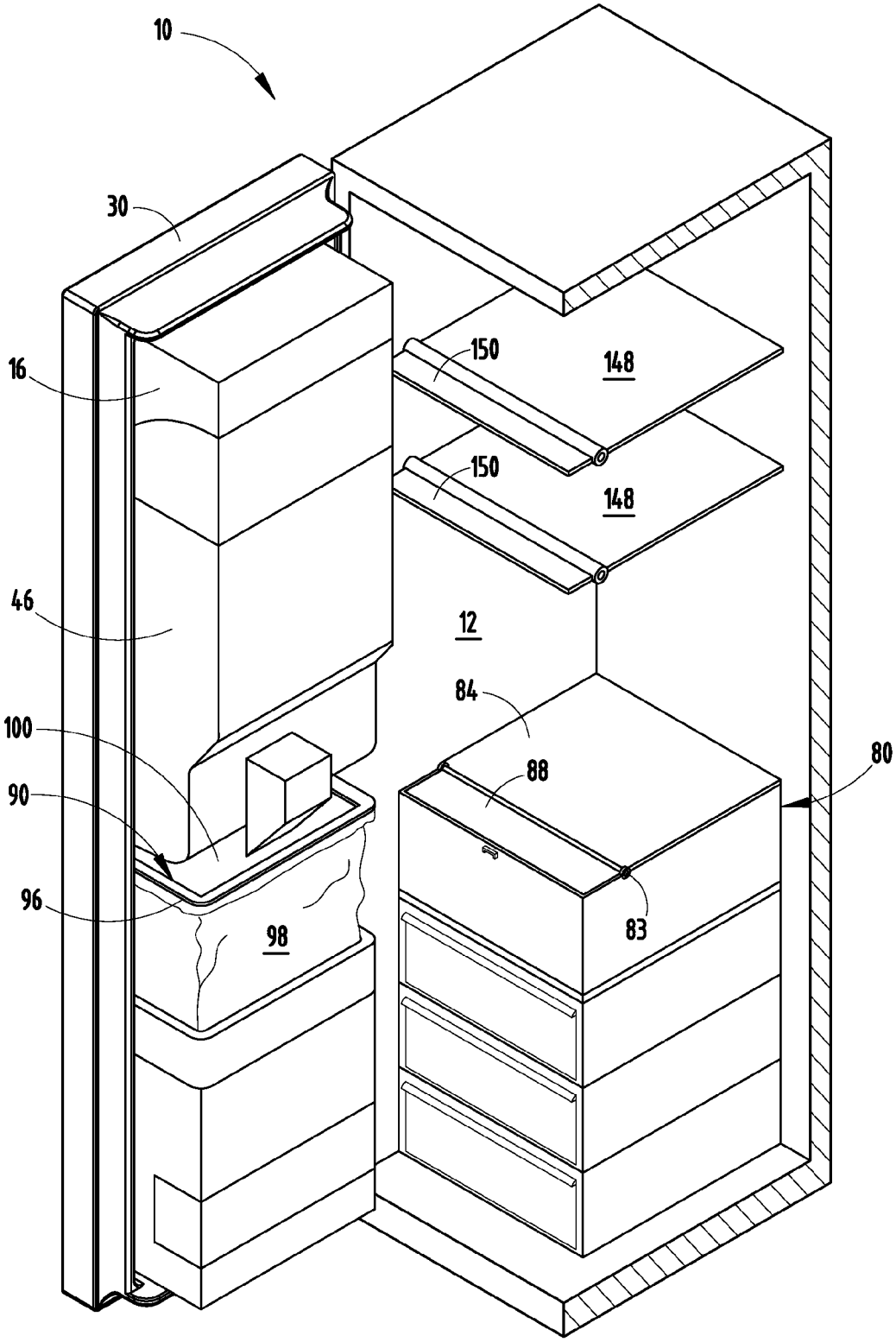
FIG. 9 is a top perspective view of one embodiment of an indoor bag storage system for ice.

FIG. 7C illustrates one embodiment of a cabinet ice bin 80 that is constructed as a high volume ice bin. The cabinet ice bin 80 may include a top door 82 pivotally connected at a hinge 83 to a top wall 84 of the cabinet ice bin 80 that is operable between open and closed positions. When the door 82 is open, ice 43 may be dropped from the ice maker 16 into an ice holding reservoir 85 in the cabinet ice bin 80. When the door 82 is closed, ice 43 is stored in the cabinet ice bin 80, but no additional ice 43 may be added. The cabinet ice bin 80 generally has a shorter height but greater depth than the door ice bin 60, although other constructions are possible, as shown in FIGS. 9 and 10. The door 82 may be a hinged door that pivots below the top wall 84 or may be a sliding door. Other constructions, as understood by a person having ordinary skill in the art, are also contemplated.

Figure 8A:
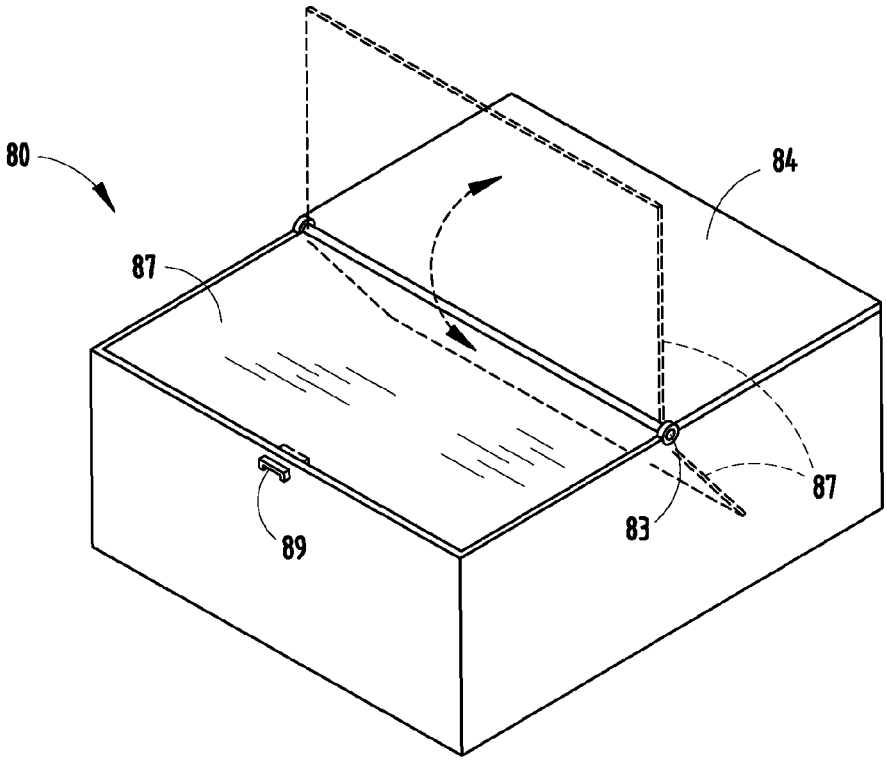
FIG. 8A is a top perspective view of one embodiment of an cabinet ice bin.
Figure 8B:
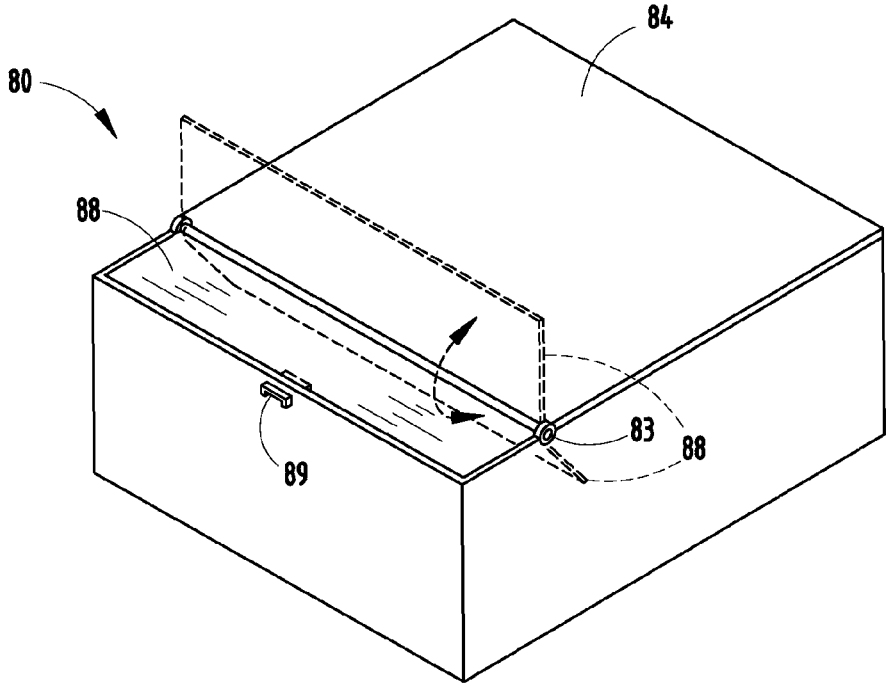
FIG. 8B is a top perspective view of one embodiment of a cabinet ice bin.

Referring now to FIGS. 8A and 8B, the cabinet ice bin 80 may include a variety of different constructions. Specifically, the cabinet ice bin 80 may include a large door 87 operably connected with the top wall 84 of the cabinet ice bin 80 that receives ice 43 from the ice maker 16 (FIG. 8A). Alternatively, the cabinet ice bin 80 may include a small door 88 for receiving ice 43 from the ice maker 16 disposed above the cabinet ice bin 80 (FIG. 8B). In both the large door 87 and small door 88 constructions, a slidable knob 89 is provided that is designed to support the doors 87, 88 in a horizontal orientation when the doors 87, 88 are closed. Other possible door constructions are also contemplated.

Figure 10A:
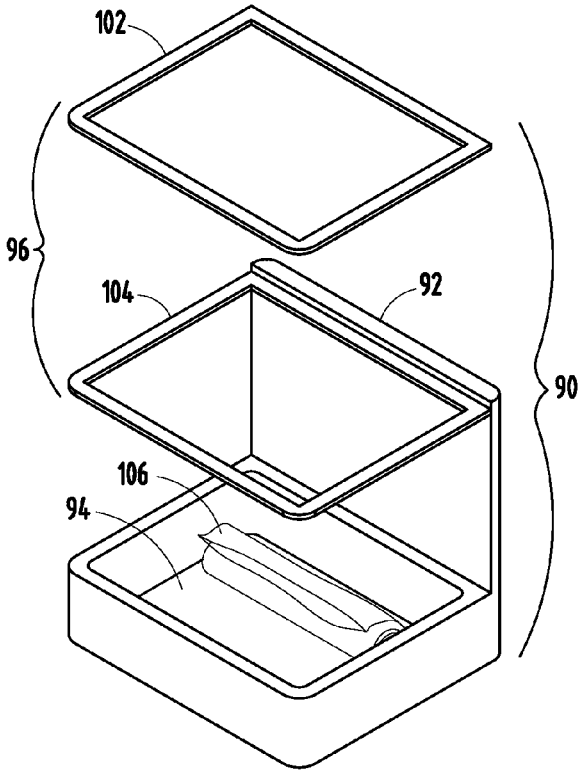
FIG. 10A is a top perspective view of one embodiment of the in-door bag storage system with the bag removed and the upper and lower frames separated.
Figure 10B:
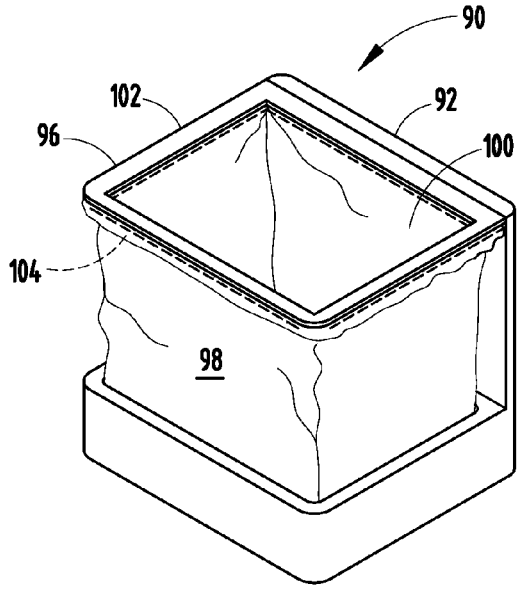
FIG. 10B is a top perspective view of the in-door bag storage system of FIG. 10A, with the bag installed in the frame assembly.

Referring now to FIGS. 9, 10A, and 10B, in another embodiment, secondary storage is obtained from an in-door bag storage system 90. The in-door bag storage system 90 includes a housing 92 with a trough 94 and a frame assembly 96 adapted to suspend and support an ice storage bag 98. The ice storage bag 98 includes an open mouth 100 that is pinched between an upper frame 102 and a lower frame 104 on the housing 92 (FIG. 9B). During use, after the ice storage bag 98 has been filled to a sufficient level, the upper frame 102 is unattached from the lower frame 104 and the ice storage bag 98 can be tied off or closed and removed from the in-door bag storage system 90. It is contemplated that a roll 106 of ice storage bags 98 may be disposed in the trough 94 of the in-door bag storage system 90. After one ice storage bag 98 filled with ice 43 is removed, a second bag 98 can be drawn from the roll 106 and pinched between the upper frame 102 and the lower frame 104, such that the open mouth 100 of the ice storage bag 98 is available for receiving ice 43.

Figure 11A:
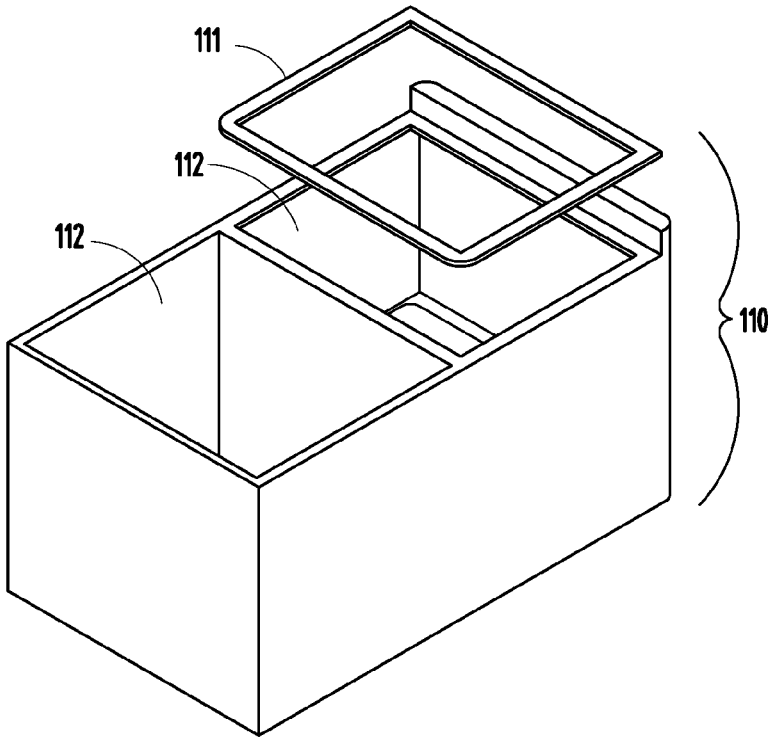
FIG. 11A is a top perspective view of another embodiment of an ice bin with dual compartment construction.
Figure 11B:
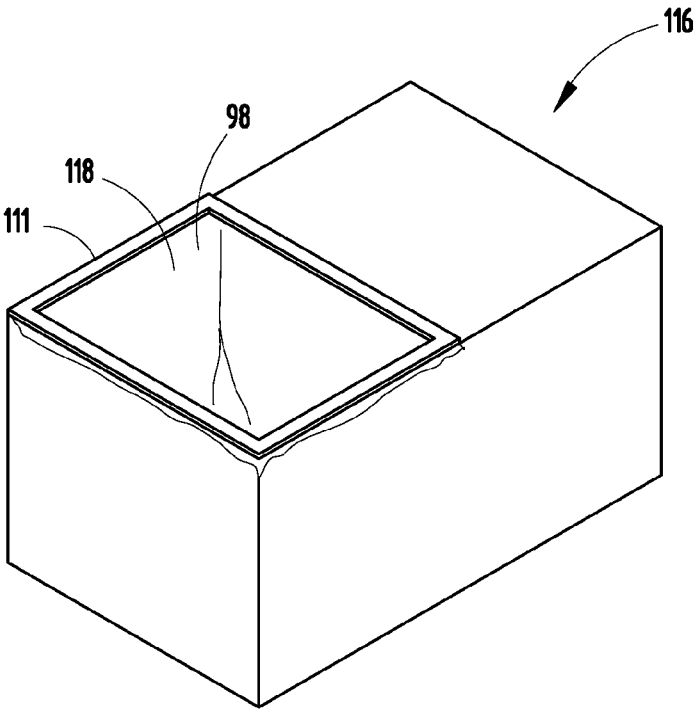
FIG. 11B is a top perspective view of another embodiment of an ice bin with an enlarged bag storage system for ice.
Figure 12A:
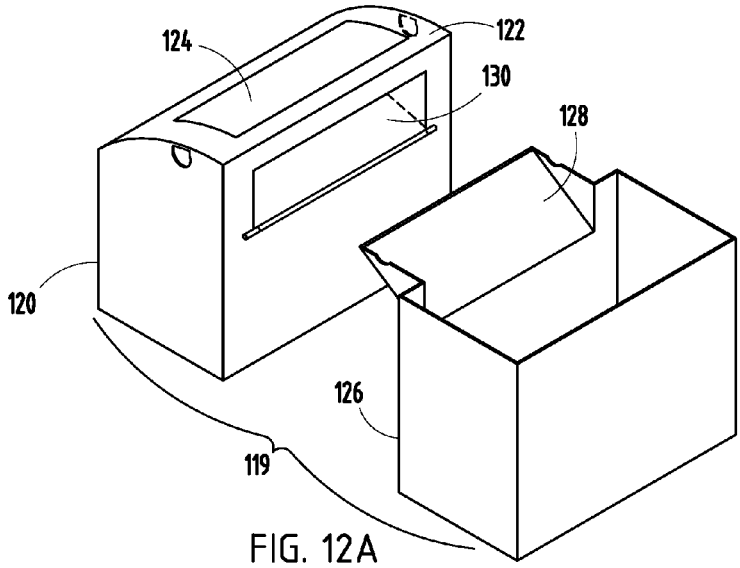
FIG. 12A is a top perspective view of one embodiment of a primary ice bin adapted for engagement with a secondary ice bin in a cabinet.
Figure 12B:
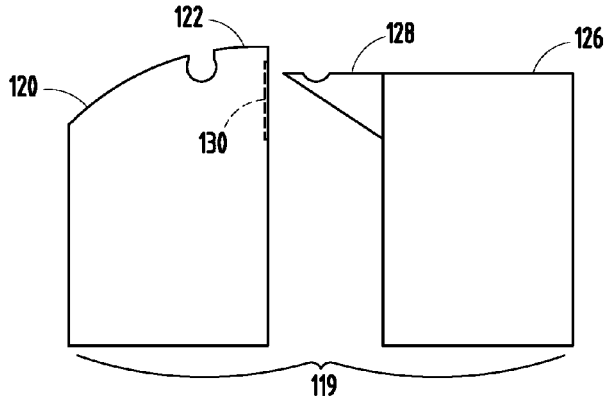
FIG. 12B is a side elevational view of the bins of FIG. 12A.

Referring now to FIGS. 11A and 11B, another embodiment of a bag storage unit 110 may be disposed in the freezer cabinet 12, which includes dual compartments 112. The dual compartments 112 are designed to receive and store ice 43 in two ice storage bags 98. The bag storage unit 110 includes a connecting rim 111 that secures the ice storage bags 98 in place in the dual compartments 112. Alternatively, a single compartment storage assembly 116 having a similar construction but with only one top opening 118 may be used (FIG. 11B). In this case, one large bag 98 is laid into the compartment storage assembly 116 and secured using the connecting rim 111 discussed above. The large bag 98 extends into a rearward compartment thereof, such that the bag 98 can hold a larger volume of ice 43 than the bags 98 that are used in the dual compartments 112.

Figure 13:
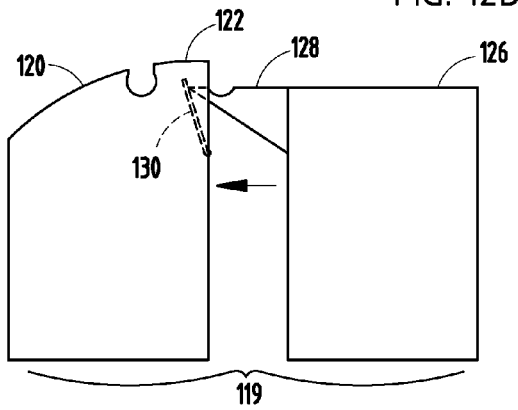
FIG. 13 is a side elevational view of a secondary ice bin engaging a primary ice bin.
Figure 14:
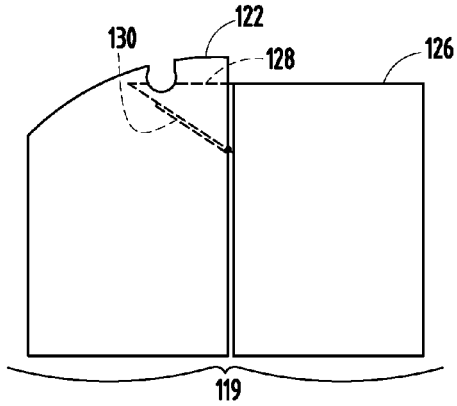
FIG. 14 is a side elevational view of a primary ice bin engaged with a secondary ice bin in an upper freezer compartment.

Referring now to FIGS. 12A-14, one embodiment of an ice management system 119 includes a primary ice bin 120 with an arcuate top 122 and an upper opening 124 for receiving ice 43 therethrough. The primary ice bin 120 is adapted for engagement with a supplemental engagement bin 126 (FIG. 13). The supplemental engagement bin 126 includes an extended protruding ice ramp 128 adapted to push against and open a spring door 130 on the primary ice bin 120 during closure of the appliance door 30. The supplemental engagement bin 126 is then able to catch ice 43 made by the in-door ice maker 16 (FIG. 1) and channel the ice 43 into the supplemental engagement bin 126 (FIG. 14). Stated differently, the extended protruding ice ramp 128 of the supplemental engagement bin 126 intercepts ice 43 that otherwise would fall into the primary ice bin 120. When the supplemental engagement bin 126 is moved away from the primary ice bin 120, the spring door 130 closes, retaining ice 43 therein. If extra ice 43 is not needed, the supplemental engagement bin 126 can be stored outside of the appliance 10 and a freezer shelf can be installed instead.

Figure 15:
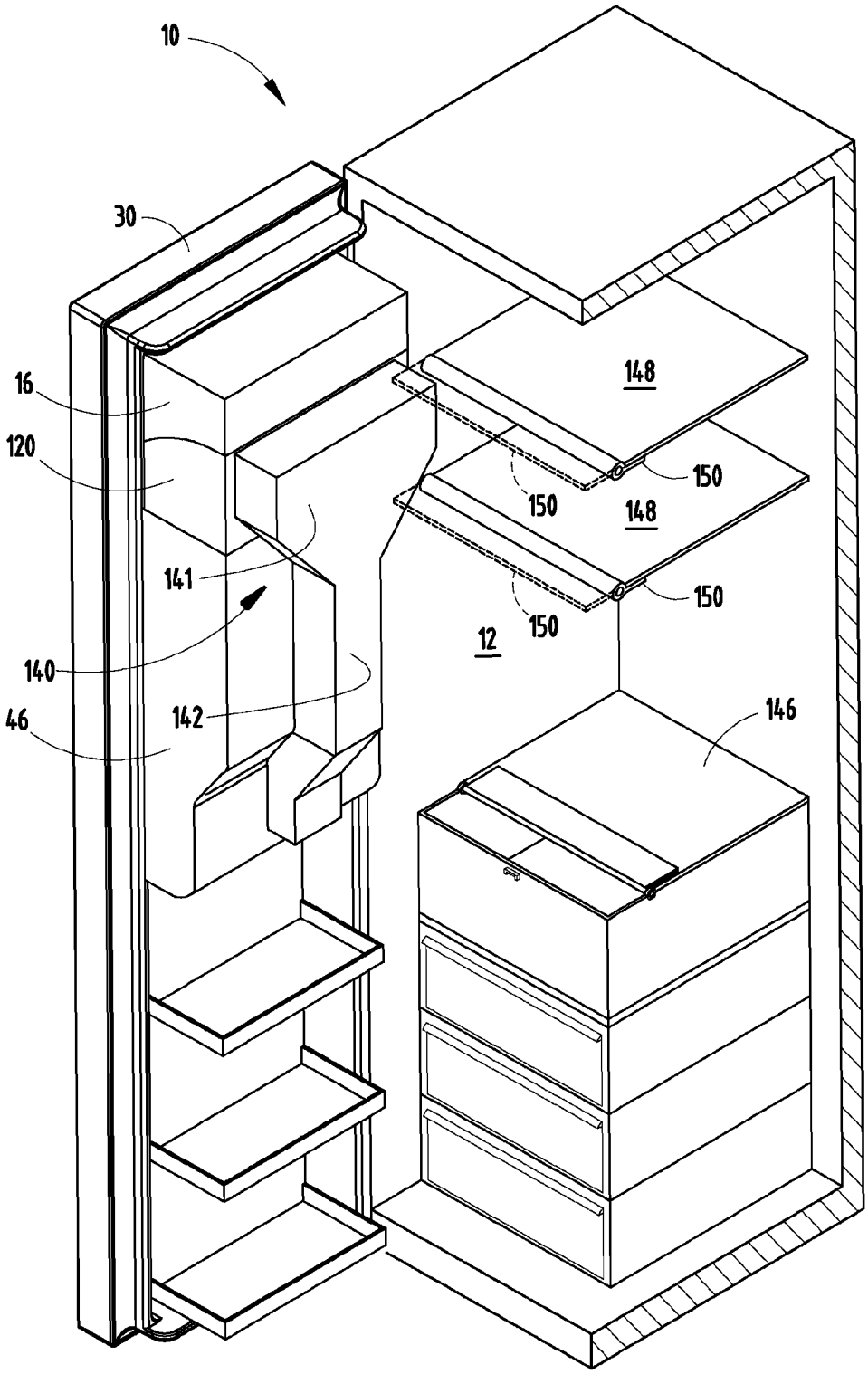
FIG. 15 is a top perspective view of one embodiment of a chute system of the present invention.

FIG. 15 illustrates one embodiment of an ice funnel system 140 that is designed to transport ice 43 down into the door ice bin 60. It will be understood that the same system could be used with the cabinet ice bin 80. The ice funnel system 140 includes a funnel 141 that narrows to an ice shaft 142 that is mounted directly or indirectly to the freezer door 30. The ice shaft 142 directs ice 43 from the ice maker 16 away from the primary ice bin 120 into a remote secondary ice bin 146. To accommodate the ice funnel 141 and ice shaft 142, shelves 148 having an adjustable or hinged front portion 150 are utilized. When the ice shaft 142 is installed, the front portion 150 is slid or hinged to a position out of interference with the ice shaft 142, so that the appliance door 30 can close properly.

Figure 16:
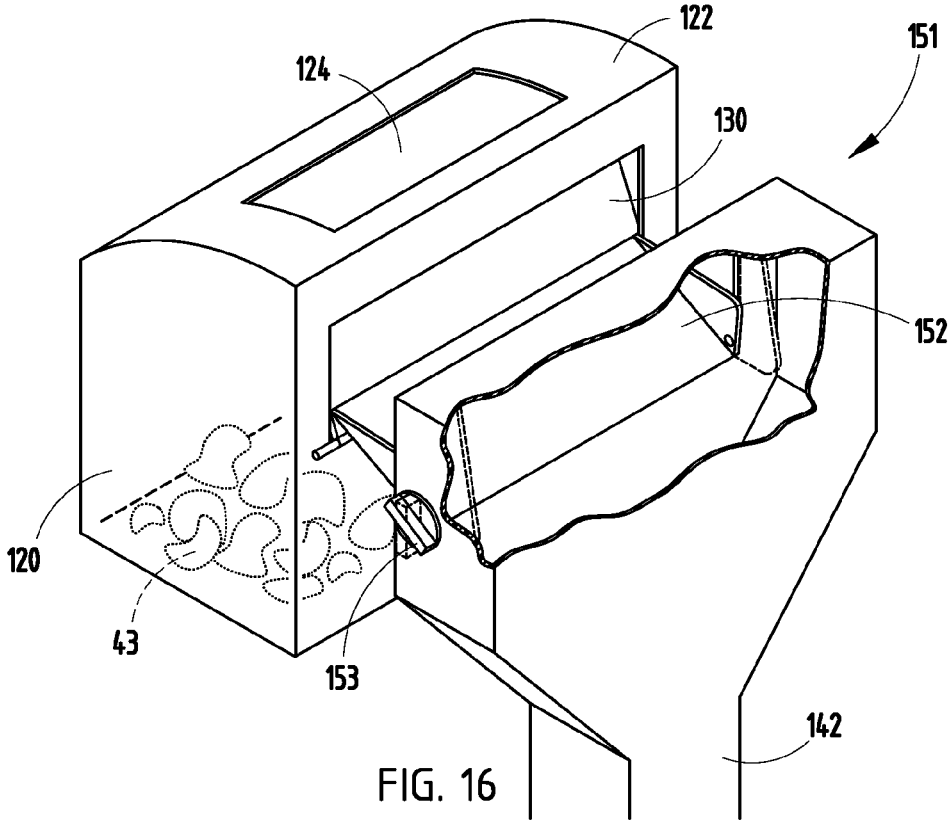
FIG. 16 is a top perspective view of one embodiment of a primary ice bin engaging with the chute system of FIG. 15.

In the illustrated embodiment of an ice bypass system 151 shown in FIG. 16, ice 43 is distributed directly to the ice shaft 142. A user manually rotates a hinged gate 152 downwardly by way of an external knob 153 that pushes the door 130 into the primary ice bin 120. The ice shaft 142 guides the ice 43 into the ice shaft 142 and deposits the ice 43 directly into the remote secondary ice bin 146. The ice shaft 142 then interrupts ice 43 dispensed into the upper opening 124 of the primary ice bin 120 from the ice maker 16. The ice funnel system 140 acts as a bypass system, wherein ice 43 from the ice maker 16 bypasses the primary ice bin 120 and goes to the remote secondary ice bin 146.

Figure 17:
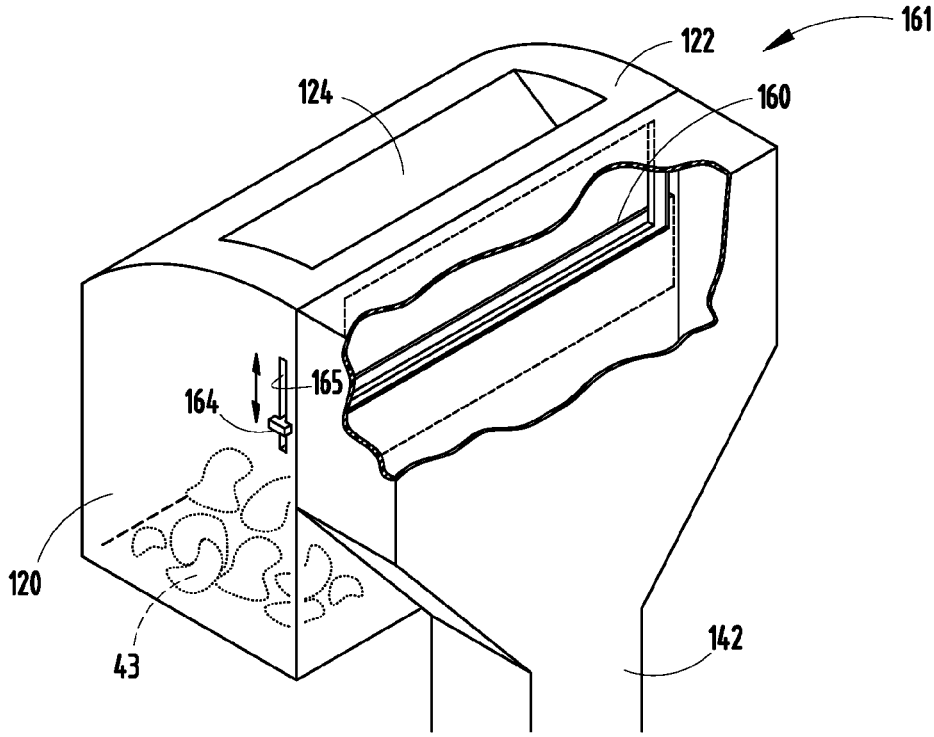
FIG. 17 is a top perspective view of another embodiment of a primary ice bin engaging with the chute system of FIG. 15.

In an ice overflow funnel system 161 illustrated in FIG. 17, ice 43 may enter the ice shaft 142 by cascading over an overfill gate 160 in the ice funnel 141. The overfill gate 160 is connected to the front of the primary ice bin 120 and once the ice 43 reaches a predetermined volume that reaches the top of the overfill gate 160, ice 43 begins to spill over into the ice funnel 141 and down into the ice shaft 142. The ice 43 travels down the ice shaft 142 until ultimately coming to rest in the remote secondary ice bin 146. The overfill gate 160 is adjustable by an external tab 164. The external tab 164 may be frictionally secured inside a slot 165 such that the overfill gate 160 can be set at various heights. After sufficient ice 43 has been secured in the remote secondary ice bin 146, the overfill gate 160 may be slid upward to close off the ice shaft 142, such that ice 43 is then stored in the primary ice bin 120 and does not overflow into the ice shaft 142. The overfill gate 160 can be set at a multitude of heights, depending on the desired volume of ice 43 to be stored in the primary ice bin 120.

Figure 18:
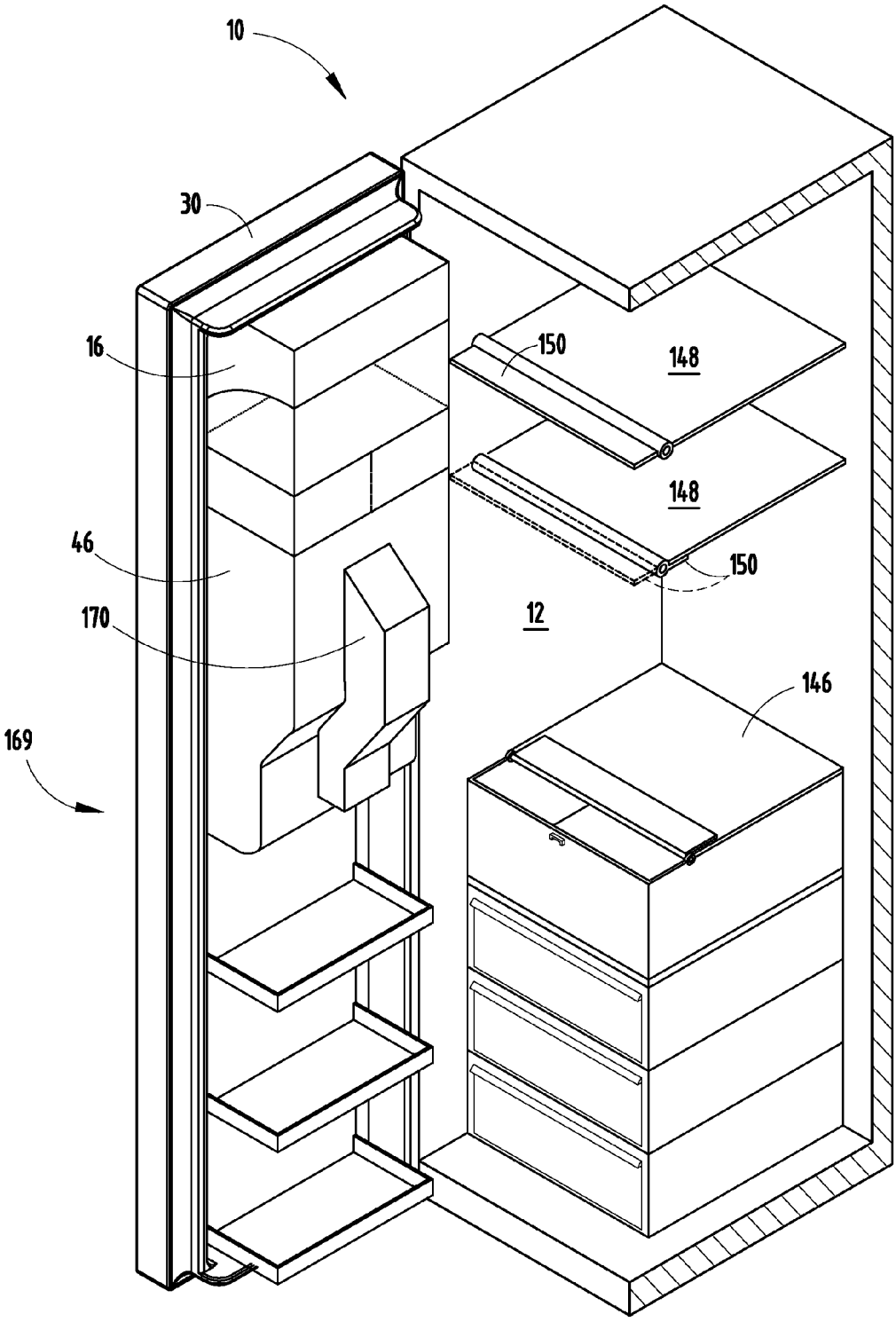
FIG. 18 is a top perspective view of one embodiment of a chute system for use in an appliance.
Figure 19A:
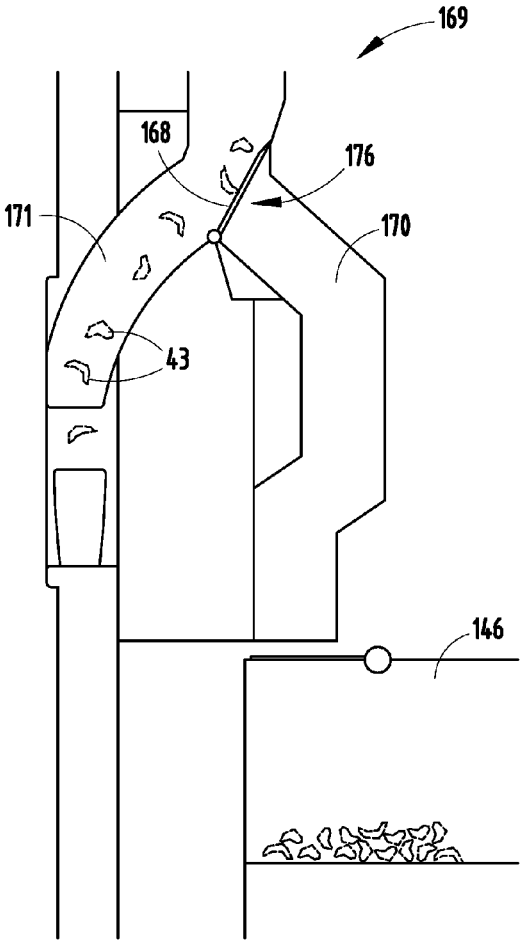
FIG. 19A is a side cross-sectional view of the chute system of FIG. 18 directing ice to an external ice dispenser.
Figure 19B:
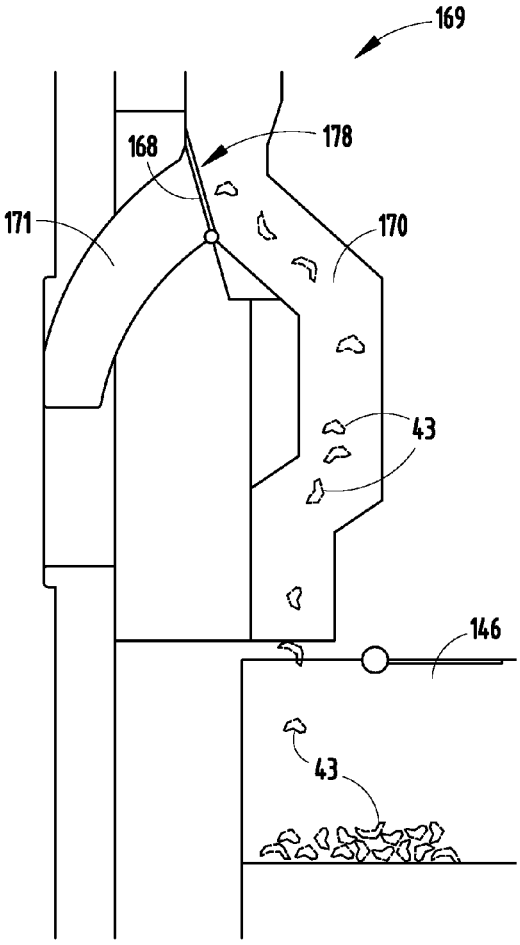
FIG. 19B is a side cross-sectional view of the chute system of FIG. 18 directing ice to a door ice bin.

Referring now to FIGS. 18, 19A and 19B, one embodiment of an ice channeling system 169 includes a directing gate 168 that is disposed in the appliance 10. The ice channeling system 169 includes an internal ice chute 170 and an external ice chute 171. The internal ice chute 170 directs ice to the remote secondary ice bin 146. The remote secondary ice bin 146 may be the door ice bin 60 or cabinet ice bin 80. The external ice chute 171 is connected with the external ice dispenser 46 in the door 30. The external ice chute 171 allows ice 43 to be dispersed externally to the user, while the internal ice chute 170 routes ice 43 into the door ice bin 60 or cabinet ice bin 80 inside the freezer cabinet 12. The directing gate 168 is located between the internal ice chute 170 and external ice chute 171 (FIGS. 19A and 19B) and directs ice 43 and is controlled manually or automatically. The directing gate 168 is disposable between a first position 176 and a second position 178. In the first position 176, ice 43 is guided down the external ice chute 171 and outward to the external ice dispenser 46. In the second position 178, the directing gate 168 is in the path of ice 43 that would otherwise be dispensed externally such that the ice 43 is now directed to flow down the internal ice chute 170 and into the remote secondary ice bin 146 (such as the cabinet ice bin 80 or door ice bin 60). The directing gate 168 may be manually or automatically adjustable.

Figure 20:
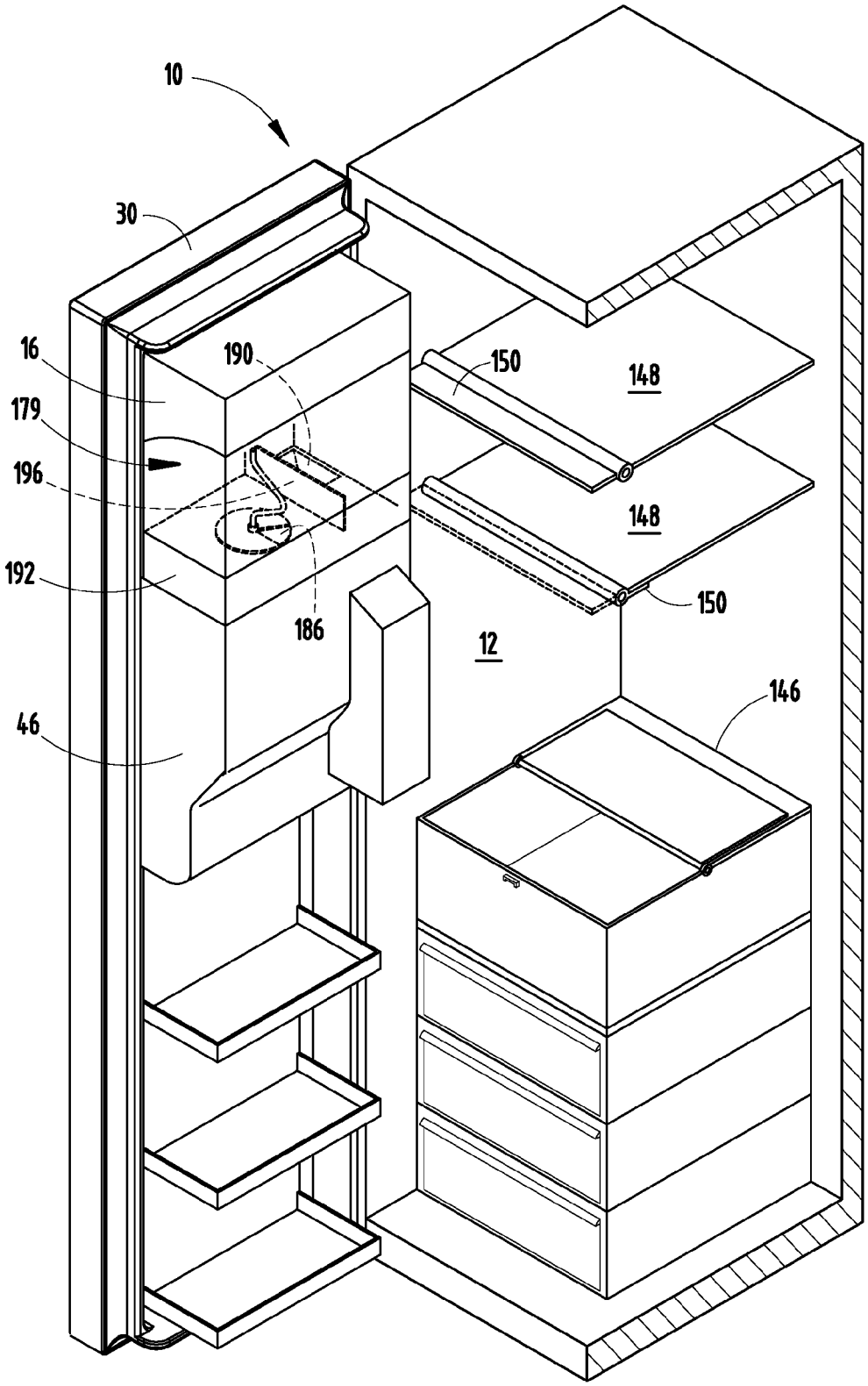
FIG. 20 is a top perspective view of an internal ice transfer system.
Figure 21:
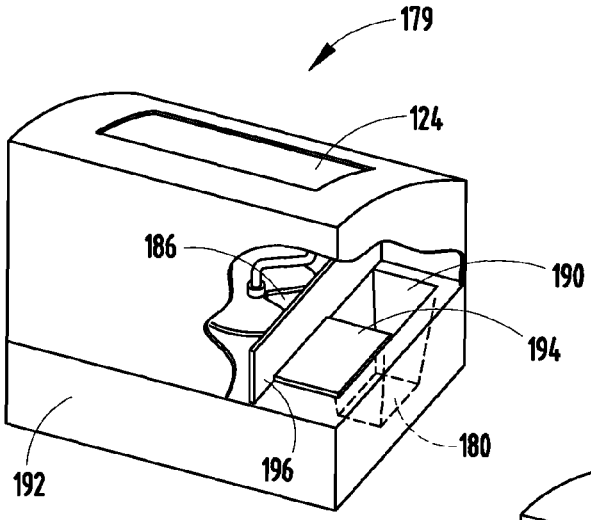
FIG. 21 is a top perspective view of the primary ice bin of the internal ice transfer system.

Referring now to FIGS. 20 and 21, one embodiment of an internal ice transfer system 179 includes an ice overflow chute 180 that relays ice 43 from the primary ice bin 120 to the remote secondary ice bin 146, which could be the door ice bin 60 or cabinet ice bin 80. The primary ice bin 120 includes a first dispensing aperture 186 that sends ice to the external ice dispenser 46 and a second dispensing aperture 190 that relays ice 43 inside the cabinet 12 of the appliance 10. The second dispensing aperture 190 extends through a base 192 of the primary ice bin 120 and is covered by a sliding manual door 194. An interior wall 196 extends upwardly inside the primary ice bin 120. When enough ice 43 is present and the door 194 is in the open position, the ice 43 will spill over the wall 196 and into the ice overflow chute 180. This system ensures that at all times some ice 43 is available for the first dispensing aperture 186 so that the consumer can obtain ice 43 from the external ice dispenser 46.

Figure 22:
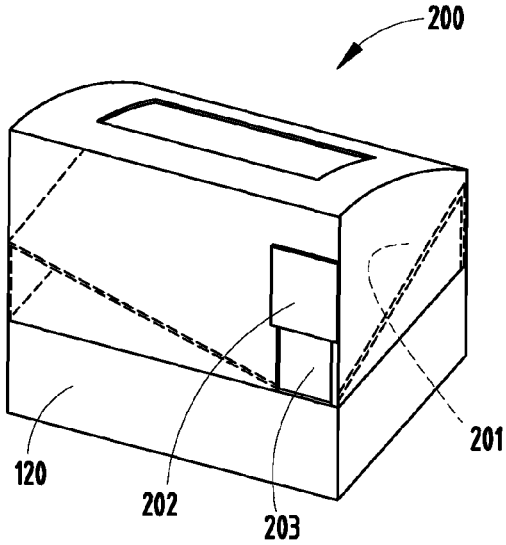
FIG. 22 is a top perspective view of a primary ice bin with an ice bin insert.

Referring now to FIG. 22, an insert system 200 that includes an ice bin insert 201 may be installed in the primary ice bin 120 to direct ice 43 to secondary storage. The ice bin insert 200 is a slanted device made from a durable material, which guides ice 43 toward a transfer door 202 on the primary ice bin 120. Ice 43 passes the transfer door 202, exits an ice exit hole 203, and is relayed by way of a cabinet ice chute 204 (FIG. 24) or a door ice chute 206 (FIG. 25). When enough ice 43 has been stored, the ice bin insert 200 may be removed and the transfer door 202 closed so that the primary ice bin 120 may be used in a conventional manner to relay ice 43 to the external ice dispenser 46.

Figure 23:
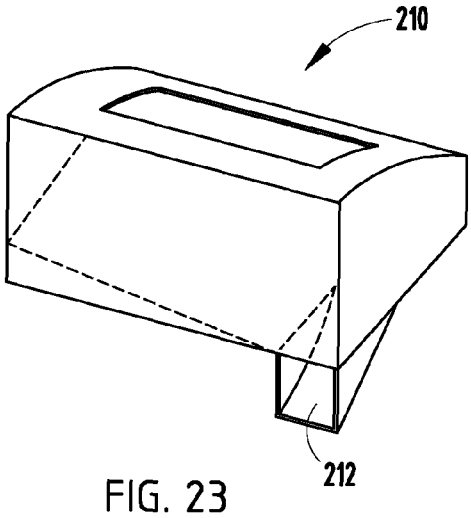
FIG. 23 is a top perspective view of a redirecting bin.

Referring now to FIG. 23, in another embodiment, a directing ice bin 210 may be installed in place of the primary ice bin 120. To use the directing ice bin 210, the primary ice bin 120 is removed, and the directing ice bin 210 is installed in place of the primary ice bin 120. The directing ice bin 210 has an ice dispensing hole 212 that directs ice 43 to the cabinet ice chute 204 (FIG. 24) or door ice chute 206 (FIG. 25) in the appliance 10. A slanted surface on the interior of the directing ice bin 210 relays ice to the ice dispensing hole 212.

Figure 24:
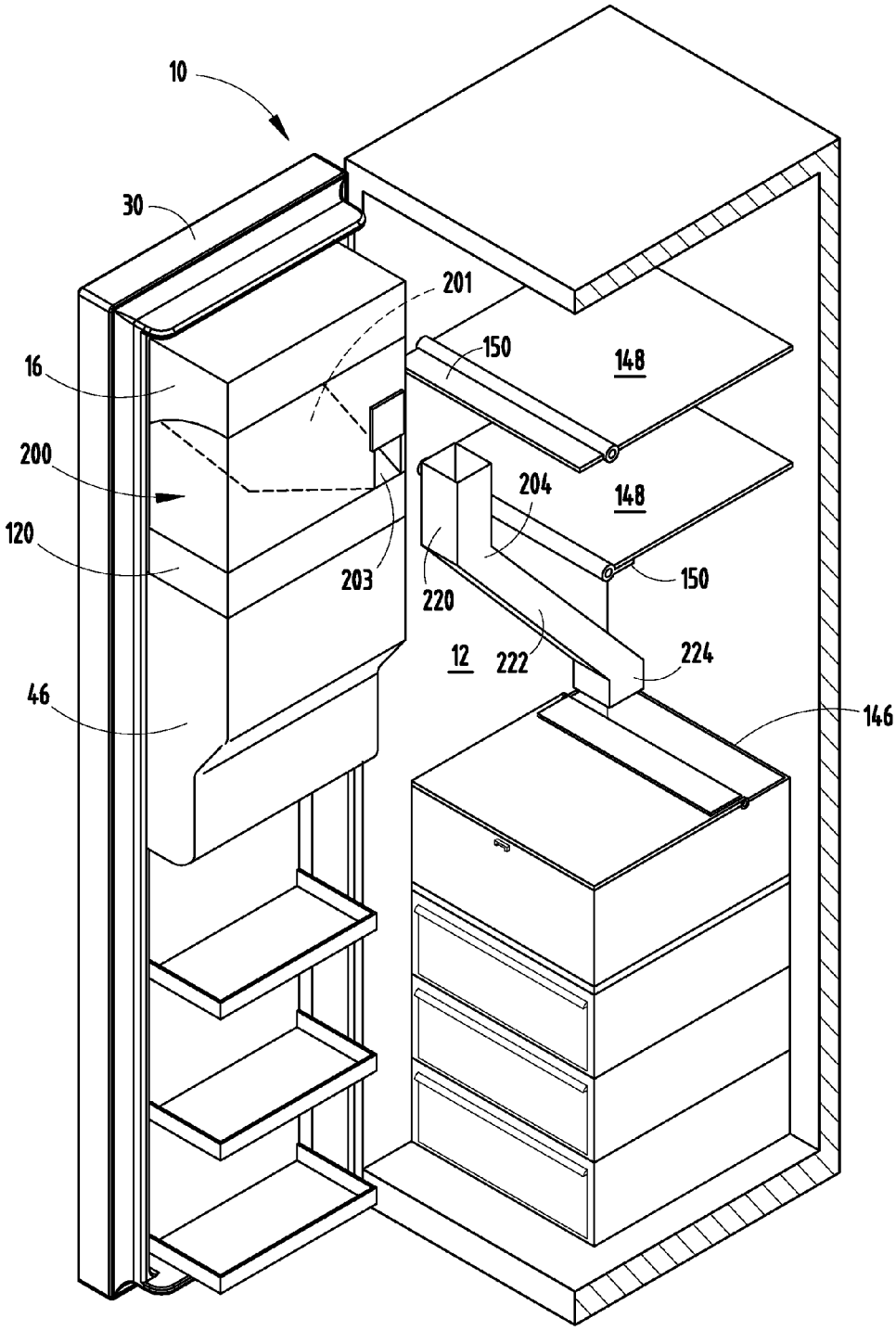
FIG. 24 is a top perspective view of one embodiment of a chute system that empties into an cabinet ice bin.
Figure 25:
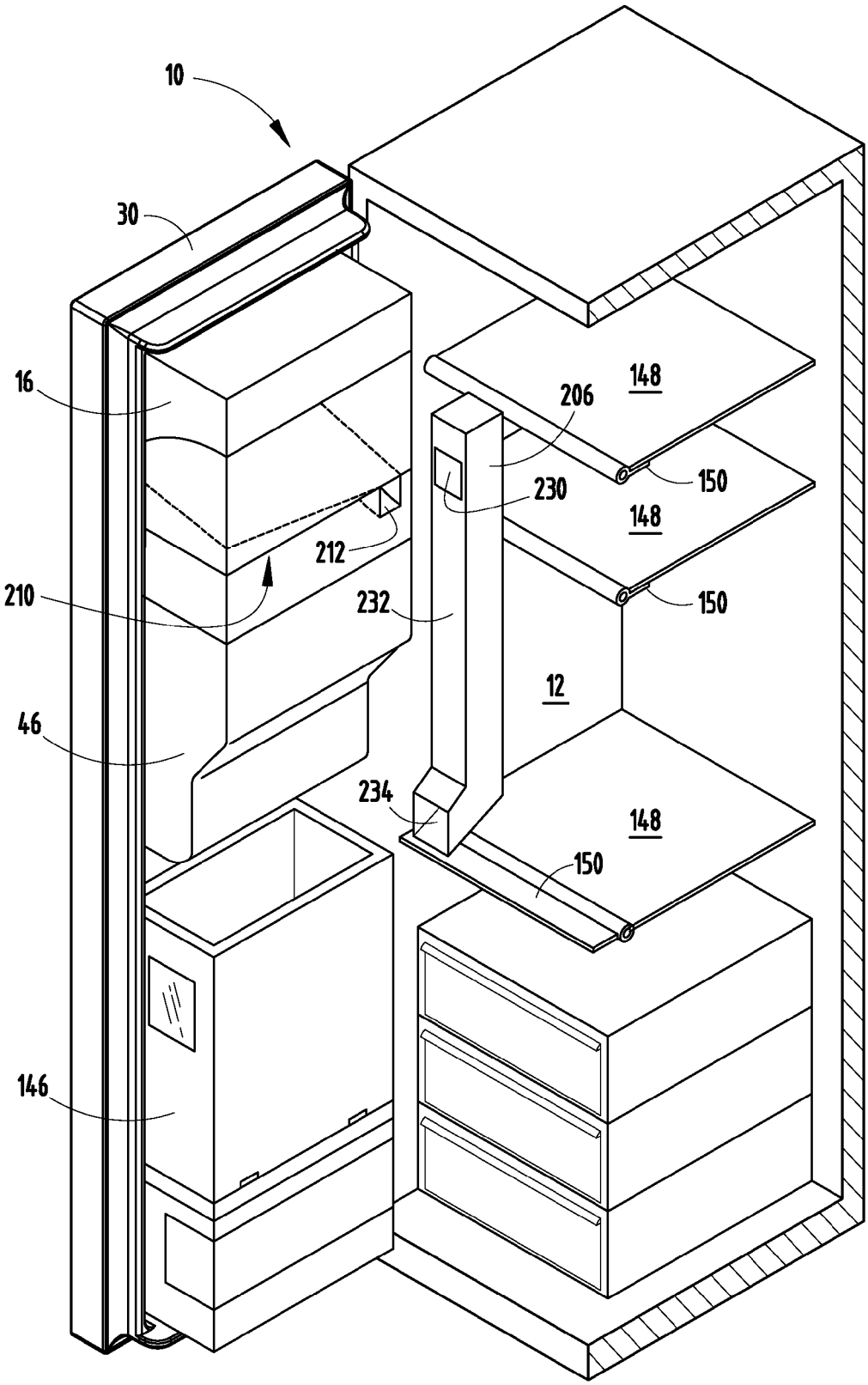
FIG. 25 is a top perspective view of one embodiment of a chute system that empties into an in-door secondary ice bin.

Referring now to FIG. 24, the cabinet ice chute 204 includes a vertical receiving portion 220, an angled transfer portion 222, and a vertical dispensing portion 224. Ice 43 that is transferred from the primary ice bin 120 having the ice bin insert 200 or the directing ice bin 210 is directed to the cabinet ice bin 80. The top door 88 in the cabinet ice bin 80 is open and disposed at a rear portion thereof for receiving ice 43 from the cabinet ice chute 204. As stated above, the cabinet ice chute 204 is designed for use with at least the ice bin insert 200 in the primary ice bin 120 and the directing ice bin 210.

Referring now to FIG. 25, the door ice chute 206 includes a receiving aperture 230, an elongate transfer portion 232, and a dispensing end 234. Ice 43 is received from one of the primary ice bin 120 that includes the ice bin insert 200 (FIG. 22) or the directing ice bin 210 (FIG. 23). Ice 43 travels down the elongate portion and is dispensed out the dispensing end 234 into the remote secondary ice bin 146, which is, in the illustrated embodiment, the door ice bin 60.

It is contemplated that many of the embodiments above could be used interchangeably. Other systems for relaying and storing ice in a freezer are also contemplated, such as those disclosed in "ROTATING RAMP AND METHOD FOR FILLING AN ICE BIN," U.S. patent application Ser. No. 12/637,203, filed on Mar. 12, 2009, and "HIGH CAPACITY ICE STORAGE IN A FREEZER COMPARTMENT," U.S. patent application Ser. No. 12/637,039, filed on Dec. 14, 2009, the entire disclosures of which are hereby incorporated herein by reference. It is also contemplated that many of the embodiments disclosed in the above-referenced applications could be used interchangeably with embodiments disclosed in the instant application.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. An appliance comprising:

a cabinet;

an ice collection area disposed inside the cabinet proximate an ice maker;

an ice storage area disposed inside the cabinet;

a first relocatable ice bin disposed inside the cabinet, wherein the first relocatable ice bin is disposed in one of the ice collection area and the ice storage area; and a second relocatable ice bin disposed inside the cabinet, wherein the second relocatable ice bin is disposed in the other of the ice collection area and the ice storage area, and wherein both the first relocatable ice bin and the second relocatable ice bin are removably attached with a door and substantially vertically aligned.

2. The appliance of claim 1, wherein the appliance includes an external ice dispenser that expels ice from the cabinet.

3. The appliance of claim 1, further comprising:

a third relocatable ice bin disposed inside the cabinet, wherein the third relocatable ice bin is disposed in the ice storage area.

4. The appliance of claim 1, wherein at least one of the first relocatable ice bin and the second relocatable ice bin includes an ice level sensor.

5. An appliance comprising:

a cabinet;

a first modular ice bin disposed inside the cabinet, the first modular ice bin being locatable in a first position wherein the first modular ice bin receives ice and a second position wherein the first modular ice bin stores ice; and a second modular ice bin disposed inside the cabinet, the second modular ice bin being locatable in the first position wherein the second modular ice bin receives ice and the second position wherein the second modular ice bin stores ice; and an external ice dispenser in the cabinet, wherein the first modular ice bin includes a trap door operably linked with the external ice dispenser.

6. The appliance of claim 5, further comprising:

a third modular ice bin disposed inside the cabinet, wherein the third modular ice bin is disposed in an ice storage area.

7. The appliance of claim 6, wherein the first modular ice bin, second modular ice bin, and third modular bin are substantially vertically aligned inside the cabinet.

8. The appliance of claim 5, further comprising:

an ice level sensor adjacent the first position.

9. The appliance of claim 5, further comprising:

a door operably connected to the cabinet, wherein at least one of the first modular ice bin and the second modular ice bin are removably attached with the door.

10. The appliance of claim 5, further comprising:

a viewing area disposed in at least one of the first modular ice bin and the second modular ice bin, the viewing area including a pane that is at least partially translucent.

11. An appliance comprising:

a cabinet;

an ice collection area disposed inside the cabinet proximate an ice maker;

an ice storage area disposed inside the cabinet;

a first relocatable ice bin disposed inside the cabinet, wherein the first relocatable ice bin is disposed in one of the ice collection area and the ice storage area;

a second relocatable ice bin disposed inside the cabinet, wherein the second relocatable ice bin is disposed in the other of the ice collection area and the ice storage area; and an external ice dispenser operably coupled to a door, wherein the first relocatable ice bin includes a trap door operably linked with the external ice dispenser.

* * * * *